US005682674A

United States Patent [19]

Yamazaki et al.

[11] Patent Number: 5,682,674

[45] Date of Patent: Nov. 4, 1997

[54] DIELECTRIC FILTER AND METHOD OF MANUFACTURING THE SAME

[75] Inventors: Kazuhisa Yamazaki, Hamamatsu; Utsuo Kihara, Kosai; Yasuo Suzuki, Toyohashi; Kazuaki Endo; Mitsuru Kojima, both of Kosai, all of Japan

[73] Assignee: Fuji Electrochemical Co., Ltd., Tokyo, Japan

[21] Appl. No.: 432,117

[22] PCT Filed: Sep. 7, 1994

[86] PCT No.: PCT/JP94/01477

§ 371 Date: May 5, 1995

§ 102(e) Date: May 5, 1995

[87] PCT Pub. No.: WO95/10861

PCT Pub. Date: Apr. 20, 1995

[30] Foreign Application Priority Data

Oct. 8, 1993 [JP] Japan ..... 5-275929
Feb. 15, 1994 [JP] Japan ..... 6-000646 U

[51] Int. Cl.[6] ..... H01P 1/203

[52] U.S. Cl. ..... 29/830; 29/600; 333/205; 333/222

[58] Field of Search ..... 333/202, 204, 333/205, 219, 222, 223, 235; 29/600, 830

[56] References Cited

U.S. PATENT DOCUMENTS 4,785,271 11/1988 Higgins, Jr. ..... 333/204
4,963,843 10/1990 Peckham ..... 333/204 X
5,075,653 12/1991 Ito et al. ..... 333/204 X
5,084,684 1/1992 Shimizu et al. ..... 333/205
5,291,162 3/1994 Ito et al. ..... 333/205
5,344,695 9/1994 Hirai et al. ..... 333/205 X

FOREIGN PATENT DOCUMENTS 0510971 10/1992 European Pat. Off. ..... 333/204
60-502032 11/1985 Japan .
61-19122 1/1986 Japan .
61-189001 8/1986 Japan .
62-104201 5/1987 Japan .
2-72001 6/1990 Japan .
2-290303 11/1990 Japan .
3-196701 8/1991 Japan .
5-110305 4/1993 Japan .
5183307 7/1993 Japan ..... 333/204
5308202 11/1993 Japan ..... 333/204

*Primary Examiner*—Benny Lee
*Assistant Examiner*—Justin P. Bettendorf
*Attorney, Agent, or Firm*—Keck, Mahin & Cate

[57] ABSTRACT

A plurality of dielectric sheets are laminated and bonded together to constitute a laminated board. A plurality of strip-shaped resonance electrodes are formed in parallel on a predetermined bonding face of the dielectric sheets, and the strip-shaped resonance electrodes reach opposite edges of the laminated board. Recesses are formed by locally cutting out the portions of the edges of the laminated board in which the respective resonance electrodes are exposed at their particular ends. Grounding electrodes are respectively formed on the obverse and reverse faces of the laminated board, and edge grounding electrodes are formed in the portions of the opposite edges of the laminated board except for the recess.

1 Claim, 5 Drawing Sheets

DIELECTRIC FILTER AND METHOD OF MANUFACTURING THE SAME

TECHNICAL FIELD

The present invention related to an improvement in a laminated chip type dielectric filter which is employed as a circuit element for a UHF- or microwave-band mobile communication unit or the like, as well as to an improvement in a method of manufacturing such dielectric filter.

BACKGROUND OF THE INVENTION

A laminated chip type dielectric filter has the following basic constitution. A plurality of dielectric sheets are laminated and bounded together to constitute one laminated board, and a plurality of strip-shaped resonance electrodes are formed in parallel on a predetermined one of the bonding faces of the dielectric sheets. Grounding electrodes are formed on the obverse and reverse faces of the laminated board. One end of each of the strip-shaped resonance electrodes is connected to the grounding electrodes in various forms, while the other end is formed as an open end. In addition, various forms of input/output electrodes are disposed in particular relation to predetermined portions of predetermined ones of the strip-shaped resonance electrodes.

The frequency characteristics of this kind of filter depend on the lengths of the respective strip-shaped resonance electrodes. Conventional dielectric filters include one type in which the lengths of individual strip-shaped resonance electrodes inserted between dielectric sheets can be finely adjusted after manufacture (Japanese Patent Publication No. 61-19122/1986), and another type in which the length of such electrodes can be finely adjusted after manufacture (Japanese Patent Laid-Open Nos. 3-196701/1991 and 5-110305/1993).

In the latter type in which the lengths of the resonance electrodes can be finely adjusted, all the resonance electrodes inserted between the dielectric sheets extend across the laminated board to reach opposite end faces thereof at their opposite ends. Accordingly, even after manufacture, it is possible to reduce the lengths of the internal resonance electrodes by arbitrarily cutting out predetermined portions of the opposite end faces of the laminated board.

Specifically, the filter disclosed in Japanese Patent Laid-Open No. 3-196701/1991 has the constitution shown in FIG. 9. As shown, two dielectric sheets 1*a* an 1*b* constitute a laminated board. Grounding electrodes 5 and 6 are formed over the entire lower face of the dielectric sheet 1*a* and the entire upper face of the dielectric sheet 1*b*, respectively. Three strip-shaped resonance electrodes 2, 3 and 4 are formed in parallel on the upper face of the dielectric sheet 1*a*.

The resonance electrodes 2, 3 and 4 extend from one edge to the opposite edge of the dielectric sheet 1*a*. Each of the resonance electrodes 2 and 4 is connected at its one end to the lower-face grounding electrode 5 via a corresponding one of grounding electrodes 2*a* and 4*a* formed on one edge of the dielectric sheet 1*a*. The central, resonance electrode 3 is connected at its one end to the lower grounding electrode 5 via a grounding electrode 3*a* formed on the opposite edge of the electric sheet 1*a*. Opposite ends (open ends) 2*b*, 3*b* and 4*b* of the respective resonance electrodes 2, 3 and 4 which are not connected to ground are exposed on the corresponding edges of the laminated board 1 at the boundary between the dielectric sheets 1*a* and 1*b*. By cutting out these exposed portions, it is possible to arbitrarily reduce the lengths of the respective resonance electrodes. In FIG. 9, reference numeral 7 denotes an input/output electrode.

The filter disclosed in Japanese Patent Laid-Open No. 5-11305/1993 has the constitution shown in FIGS. 10A and 10B. The two dielectric sheets 1*a* and 1*b* constitute the laminated board 1. The grounding electrodes 5 and 6 are formed over the entire lower face of the dielectric sheet 1*a* and the entire upper face of the dielectric sheet 1*b*, respectively. The three strip-shaped resonance electrodes 2, 3 and 4 are formed in parallel on the upper face of the dielectric sheet 1*a*.

The resonance electrodes 2, 3 and 4 extend from one edge to the opposite edge of the dielectric sheet 1*a*. Each of the resonance electrodes 2 and 4 is connected at its one end to the lower and upper edge grounding electrodes 5 and 6 via a corresponding one of the edge grounding electrodes 2*a* and 4*a* deposited on the inner faces of edge through-holes 8 formed in one side edge of the laminated board 1. The central, resonance electrode 3 is connected at its one end to the lower and upper edge grounding electrodes 5 and 6 via the edge grounding electrode 3*a* deposited on the inner face of the edge through-hole 8 formed in the opposite edge of the laminated board 1. The opposite ends (open ends) 2*b*, 3*b* and 4*b* of the respective resonance electrodes 2, 3 and 4 which are not connected to ground are exposed on the corresponding flat side edges of the laminated board 1 at the boundary between the dielectric sheets 1*a* and 1*b*. By cutting out these flat side edges, it is possible to arbitrarily reduce the lengths of the respective resonance electrodes. In FIGS. 10A and 10B, reference numeral 7 denotes an input/output electrode.

In the prior art shown in FIG. 9, the edge grounding electrodes 2*a*, 3*a* and 4*a* are locally formed on either side edge of the laminated board 1, as by screen printing. The patterning of such partial metal films on the side edges of a laminated board having the shape of a flat rectangular parallelepiped block requires an excessively time-consuming and complicated operation, which results in impairing of the productivity of this kind of filter.

In the prior art shown in FIGS. 10A and 10B, since through-hole techniques are applied to form the edge grounding electrodes 2*a*, 3*a* and 4*a*, it is possible to realize mass-productivity higher than that achievable in the prior art shown in FIG. 9. However, as the hole diameters of the through-holes become larger, it becomes more difficult to uniformly form electrode film on the inner faces of the respective through-holes and a more complicated process is needed. For this reason, this prior art has not yet reached a satisfactory level in terms of mass-productivity.

Further, both prior arts shown in FIG. 9 and FIGS. 10A and 10B have the following disadvantage in common. Since the open ends 2*b*, 3*b* and 4*b* of the respective resonance electrodes 2, 3 and 4 which are not connected to ground are exposed on external edges of the laminated board 1, no good shielding characteristics are obtained. Accordingly, if such a dielectric filter is mounted on a circuit board at high density together with other circuit elements, the characteristics of the dielectric filter will be easily varied under the influence of distributed capacitance, depending on the distance between the dielectric filter and an adjacent component.

DISCLOSURE OF THE INVENTION

The present invention has been made in light of the above-described background, and its primary object is to provide the structure of a dielectric filter having high mass-productivity and superior shielding characteristics as well as a method of manufacturing such a dielectric filter.

Another object of the present invention is to provide a laminated dielectric filter having a dielectric filter structure which can be manufactured without coating a solder resist on the portion of a mounting face on which no electrode is formed.

A dielectric filter according to the present invention comprises a laminated board including a plurality of dielectric sheets bonded together, a plurality of strip shaped resonance electrodes formed in parallel on a predetermined bonding face of the plurality of dielectric sheets, input/output electrodes connected to the strip-shaped resonance electrodes, and grounding electrodes formed on peripheral edges of the laminated board. In the dielectric filter, each of the resonance electrodes extends to opposite edges of the laminated board so that one end thereof is connected to the grounding electrode formed on a corresponding one of the opposite edges, while the other end is separated from the grounding electrode by a recess formed at a predetermined location in a corresponding one of the opposite edges.

In a method of manufacturing the aforesaid dielectric filter, the dielectric sheets are laminated, and parallel strip-shaped resonance electrode patterns and input/output electrode patterns of predetermined shapes are formed on a surface of a predetermined one of the dielectric sheets. After the dielectric sheets are joined by thermocompression, through-holes are formed by machining at positions where dielectric sheets are cut for the resonance electrode patterns. Then, the recesses as well as the laminated board are formed by cutting the dielectric sheets at predetermined positions which pass through the respective through-holes. Thereafter, the laminated board is sintered.

The portions of each of the opposite edges of the laminated board that exclude all recesses are positioned in the same plane, and only the portions excluding all recesses are coated with electrically conductive film, whereby the edge grounding electrodes are formed. The edge grounding electrodes can be extremely easily formed while performing the step of forming electrode film over the entire edges. One end of each of the aforesaid resonance electrodes is separated from either of the edge grounding electrodes by the corresponding one of the recesses, and the thus-separated one end is an open end. This open end is exposed in the recess at the boundary between the two dielectric sheets, and the length of the corresponding resonance electrode can be reduced by cutting out the portion of the laminated board that defines the recess. However, since the exposed open end recedes into the recess, the dielectric filter is far superior in shielding characteristics to the prior art filters in which the open end is exposed on the external face of the laminated board.

In addition, a laminated body including dielectric sheets each having particular electrode portions may have a constitution that an electrically insulating sheet having openings at positions corresponding to input/output terminals and grounding terminals is stacked on a mounting face on which circuit components, such as electrodes, are mounted. In this case, it is desirable that the sheet having the openings have good adhesion to the aforesaid dielectric sheet. Thus, a finished chip product is formed with its mounting face being solder-masked with a sheet having patterns corresponding to electrode portions which are formed so that only the electrode portions, such as the input/output terminals and the grounding terminals, can be exposed and a portion with no electrode portion being formed can serve as a mask.

BRIEF DESCRIPTION OF DRAWINGS

FIGS. 13A, 13B and 13C are perspective views of an interdigital type filter, showing another embodiment of the present invention, wherein FIG. 13B is an enlarged view of an encircled portion C of FIG. 13A, and FIG. 13B is an exploded perspective view.

BEST MODE FOR CARRYING OUT THE INVENTION

Figure 1A:
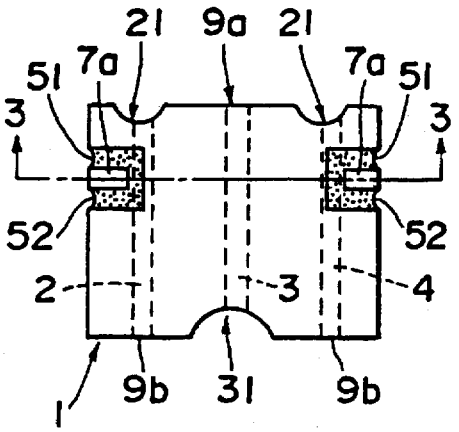
FIG. 1A is a plan view of a dielectric filter according to a first embodiment of the present invention.
Figure 1B:
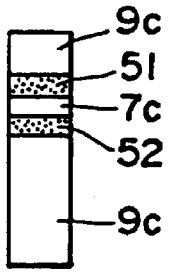
FIG. 1B is a side view of the dielectric filter shown in FIG. 1A.
Figure 2:
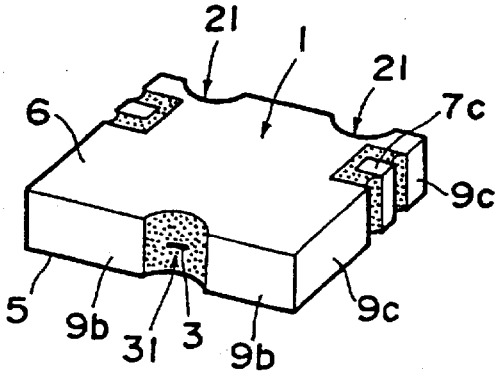
FIG. 2 is a perspective view of the dielectric filter according to the first embodiment.
Figure 3:
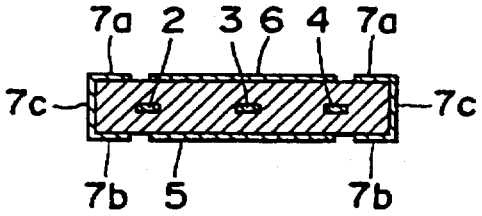
FIG. 3 is a cross-sectional view taken along line 3—3 of FIG. 1A.

Preferred embodiments of a dielectric filter according to the present invention and a method of manufacturing the same will be described below with reference to the accompanying drawings.

An embodiment of a dielectric filter according to the present invention is shown in FIGS. 1A to 3. As shown, a plurality of dielectric sheets are laminated and bonded together to constitute a laminated board 1 having the shape of a flat rectangular parallelepiped. An obverse grounding electrode 6 is formed substantially over the entire obverse face of the laminated board 1, and two obverse input/output electrodes 7*a* are locally formed. Similarly, a reverse grounding electrode 5 is formed substantially over the entire reverse face of the laminated board 1, and two reverse grounding electrodes 7*b* are locally formed.

Three strip-shaped resonance electrodes 2, 3 and 4 are formed in parallel on a predetermined one of the bonding faces of the plurality of dielectric sheets which constitute the laminated board 1. The resonance electrodes 2, 3 and 4 extend from the upper edge to the lower edge of the laminated board 1. The upper edge of the laminated board 1 is locally cut out to form arc-shaped recesses 21 in which the upper ends of the resonance electrodes 2 and 4 are respectively exposed. Upper edge grounding electrodes 9*a* are formed in the portion of the upper edge of the laminated board 1 that excludes the two recesses 21.

The lower edge of the laminated board 1 is locally cut out to an arc-shaped recess 31 in which the lower end of the resonance electrode 3 is exposed. Lower edge grounding electrodes 9b are formed in the portion of the lower edge of the laminated board 1 that excludes the recess 31. The lower ends of resonance electrodes 2 and 4 are respectively connected to the lower edge grounding electrodes 9b. The upper end of the resonance electrode 3 is connected to the upper edge grounding electrodes 9a.

In addition, the cut depth of the recess 31 is selected to be greater than that of the recesses 21. Thus, the central, resonance electrode 3 is shorter than the resonance electrodes 2 and 4 on the opposite sides of the resonance electrode 3. The resonance electrodes 2 and 4 formed on the opposite sides of the resonance electrode 3 have the same length since the positions of their open ends are determined by the respective recesses 21 and 21 of the same shape.

The right and left side edges of the laminated board 1 are locally cut out so that two pairs of small recesses 51 and 52 are formed at predetermined positions, respectively. Electrode films are respectively formed on the portions of the right and left edges of the laminated board 1 that exclude that two pairs of recesses 51 and 52. Of the electrode films., the small portions formed between the recesses 51 and 52 respectively constitute right and left input/output electrodes 7c, and the right ones of the other large portions constitute right edge grounding electrodes 9c, while the left ones constitute left edge grounding electrodes 9c. As shown, the obverse and reverse input/output electrodes 7a and 7b are electrically connected to the right and left edge input/output electrodes 7c. The layout of these input/output electrodes is mainly intended for electric-field coupling and the input/output electrodes on one side are electromagnetically coupled to the respective ones on the other side in an intermediate portion between the resonance electrodes 2 and 4. Of course, all the obverse, reverse, right and left edge grounding electrodes are electrically connected to one another.

As is apparent from the above description, the resonance electrodes 2 and 4 reach the lower edge and are connected to the corresponding grounding electrodes 9b at their ends, while the other ends of the resonance electrodes 2 and 4 are respectively exposed in the recesses 21 formed in the upper side face of the laminated board 1. Accordingly, by further cutting out the portions of the laminated board 1 that define the respective recesses 21, it is possible to arbitrarily reduce the lengths of the resonance electrodes 2 and 4. Similarly, the resonance electrode 3 reaches the upper edge of the laminated board 1 and is connected to the middle one of the upper edge grounding electrodes 9a at its one end, while the other end of the resonance electrode 3 is exposed at the bottom of the recess 31 formed in the lower edge of the laminated board 1. Accordingly, by further cutting out the portion of the laminated board 1 that defines the recess 31, it is possible to arbitrarily reduce the length of the resonance electrode 3. In addition, since the open end of each of the resonance electrodes is positioned at the bottom of the corresponding recess which recedes from the external face of the laminated board 1, shielding characteristics are improved so that the influence of neighboring constituent components on characteristics can be eliminated.

Figure 4:
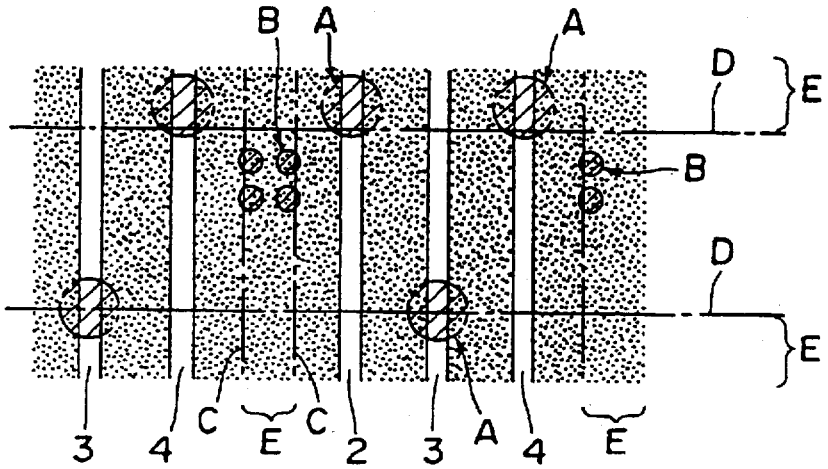
FIG. 4 and 5 are diagrammatic views for explaining a mass-production system for the dielectric filter according to the first embodiment.

A manufacturing method according to the present invention will be described below. According to this embodiment, a multiplicity of dielectric filters can be produced at one time in the manner shown in FIG. 4, whereby mass-productivity is extremely improved. As shown in FIG. 4, a multiplicity of laminated boards are produced by employing large dielectric sheets each formed by laminating a predetermined number of green sheets. Strip-shaped electrode patterns which constitute the aforesaid resonance electrodes 2, 3 and 4 are previously formed in parallel between the dielectric sheets.

Then, large round holes, designated at A, which constitute the recesses 21 and 31 are formed to extend through the dielectric sheets by machining, such as drilling or punching, and small round holes B which constitute the recesses 51 and 52 are formed to extend through the same. Since the round holes A and B are formed to extend through the large-area dielectric sheets, each of the patterns for the resonance electrodes 2, 3 and 4 may be formed as one long strip-shaped pattern on either of the dielectric sheets and there is no need to form a complicated pattern which is cut or bent at predetermined positions. Accordingly, the dielectric filters can be readily manufactured.

In a three-stage filter as the filter of this embodiment, the central resonance electrode 3 is shorter than the resonance electrodes 2 and 4. Accordingly, in the present embodiment, although it is necessary to enlarge the amount of cut for the recess 31 which corresponds to the central resonance electrode 3, the round holes A of the same diameter are formed for ease of manufacturing and such different amount of cut are ensured by shifting cutting lines C and D from the centers of the respective round holes.

Figure 5:
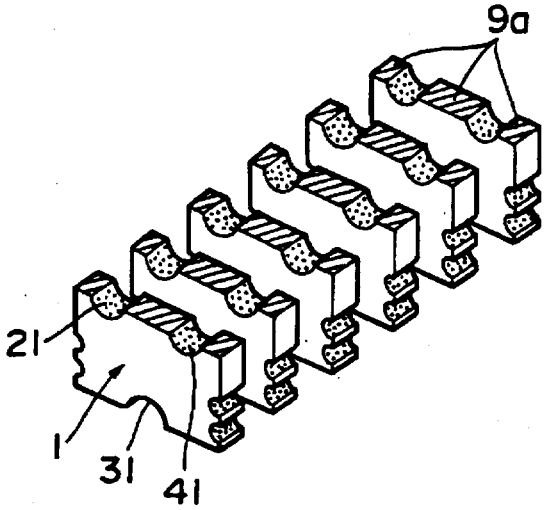
Figure 9:
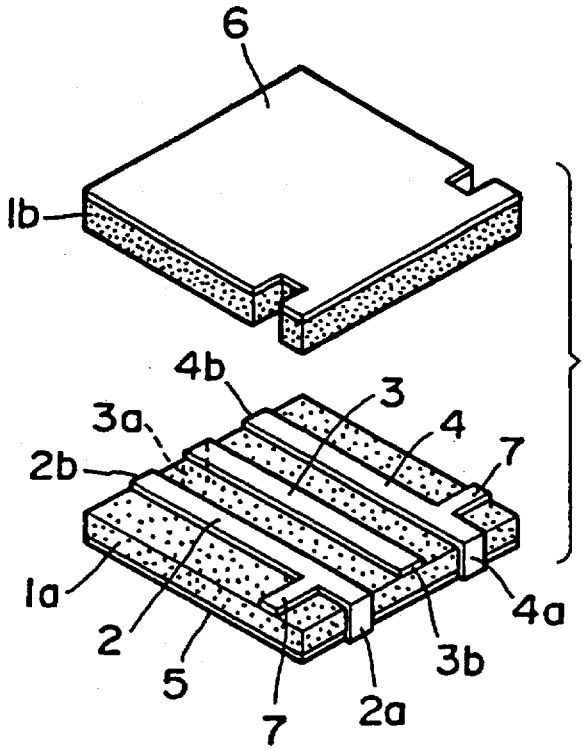
FIG. 9 (PRIOR ART)
FIGS. 9, 10A and 10B show the constitutions of conventional dielectric filters.
Figure 10A:
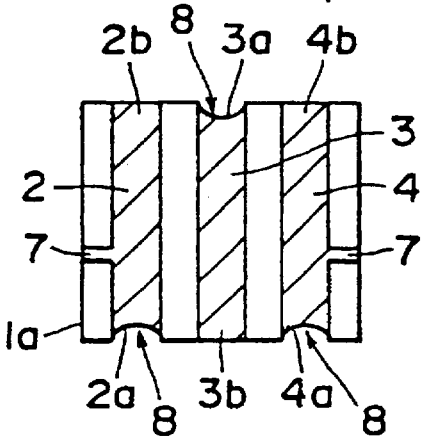
FIG. 10A (PRIOR ART)
Figure 10B:
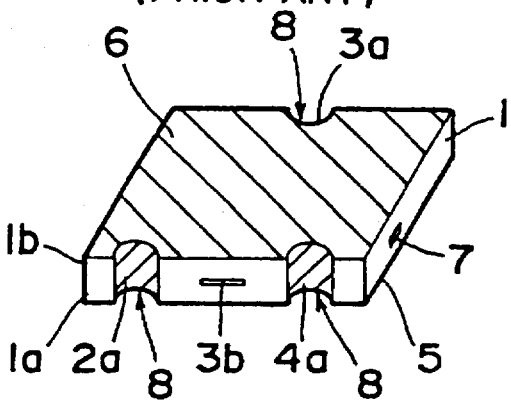
FIG. 10B (PRIOR ART)

Filter elements each having the shape shown in FIG. 5 are formed by cutting the large laminated board along the vertical and horizontal lines C and D. The filter elements are aligned by using an appropriate tool, and metal film is formed on the hatched portions shown in FIG. 9 by solid printing. Thus, edge grounding electrodes are formed on the portion of the edge of each of the filter elements that excludes the recesses. The step of forming the edge grounding electrodes on the portions of the edge of each of the laminated board that exclude the recesses is substantially as simple as the step of forming an electrode film over the entire edge. Accordingly, the step of forming the edge grounding electrodes becomes very simple, whereby the overall mass-productivity is improved.

In the present embodiment, the positions at which are formed the respective round holes A for the recesses 21 and 31 are shifted from the centers of the corresponding cutting lines D, and the amounts of cut for the respective round holes A are varied to form each of the resonance electrodes 2, 3 and 4 into a predetermined length. However, the present invention is not limited to this method, and the recesses 21 and 31 may be formed by using round holes having different diameters. In this case, if the centers of the respective round holes A and B are positioned on the vertical and horizontal lines C and D (the adjacent ones of the vertical lines C (C) are made coincident with each other), the portions E shown in FIG. 4 which would have been waste areas are eliminated, whereby efficient use of material is achieved.

Figure 6:
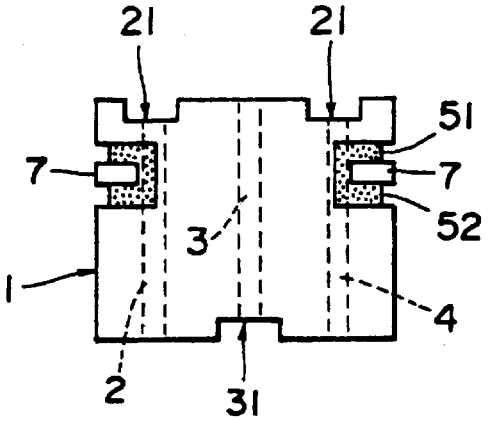
FIG. 6 is a plan view of a dielectric filter according to a second embodiment of the present invention.
Figure 7A:
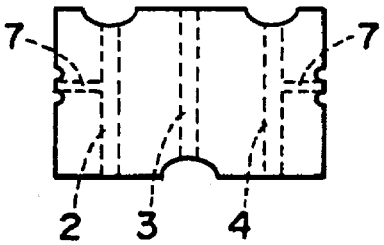
FIGS. 7A and 7B are a plan view and a side view, respectively, showing a dielectric filter according to a third embodiment of the present invention.
Figure 7B:
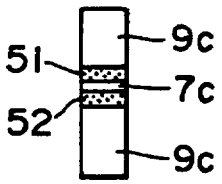
Figure 8A:
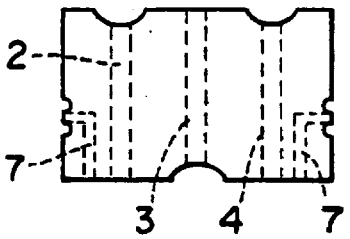
FIGS. 8A and 8B are a plan view and a side view, respectively, showing a dielectric filter according to a fourth embodiment of the present invention.
Figure 8B:
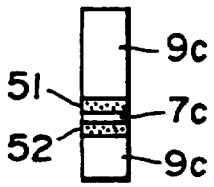

Another embodiment of the dielectric filter according to the present invention will be described below. Although the aforesaid recessed formed by cutting out the edges of the laminated board have and arc-shaped shape which constitutes part of a round hole, such recesses may also have various other shapes, such as the rectangular shape shown in FIG. 6. The layout of the input/output electrodes is not limited to the layout mainly intended for electric-field coupling, which is used in the previously-described embodiment, and may also be of the branch coupling type shown in FIGS. 7A and 7B or the magnetic-field coupling type shown in FIGS. 8A and 8B. In the embodiments shown in FIGS. 7A to 8B, although the types of coupling between input/output electrodes 7 are different, the other essential portions are similar to those of the previously-described embodiment. Therefore, the same reference numerals are used to denote such similar and essential portions, and detailed description thereof is omitted. In addition, although not specifically shown, a filter having two stages or four or more stages may also be formed instead of any of the three-stage filters used in the above-described embodiments. Of course, a comb-line type of constitution, in which the open ends of resonators are arrayed on the same side face, may also be adopted instead of the interdigital type of constitution, in which the open ends of resonators are alternately arrayed, used in the present invention.

As described above in detail, according to this invention, one end of each of the resonance electrodes inside the laminated board is separated from both edge grounding electrodes by the corresponding one of the recesses formed by cutting out the edges of the laminated board, and the thus-separated end of each of the resonance electrodes constitutes an open end. These open ends are exposed in the respective recesses in the boundary between two dielectric sheets, and the lengths of the resonance electrodes can be reduced by further cutting out the respective exposed end portions. However, the exposed open ends, located within the respective recesses, have shielding characteristics far superior to those of an arrangement in which open ends are exposed on an external face. The step of forming the edge grounding electrodes on the portions of the opposite edges of the laminated board that exclude the recesses is substantially as simple as the step of forming an electrode film over the entire edge. Accordingly, mass-productivity is improved.

A laminated body Including the aforesaid dielectric sheets each having particular electrode portions may have a constitution in which an electrically insulating sheet having openings at positions corresponding to input/output terminals and grounding terminals is stacked on a mounting face on which circuit components, such as electrodes, are mounted. In this case, it is desirable that the sheet having the openings have good adhesion to the aforesaid dielectric sheet. Thus, a finished chip product is formed with its mounting face being solder-masked with a sheet having patterns corresponding to electrode portions which are formed so that only the electrodes portion, such as the input/output terminals and the grounding terminals, can be exposed and a portion on which the electrode portions are not formed can serve as a mask. This constitution will be described below in brief with reference to FIGS. 11 and 12.

Figure 11:
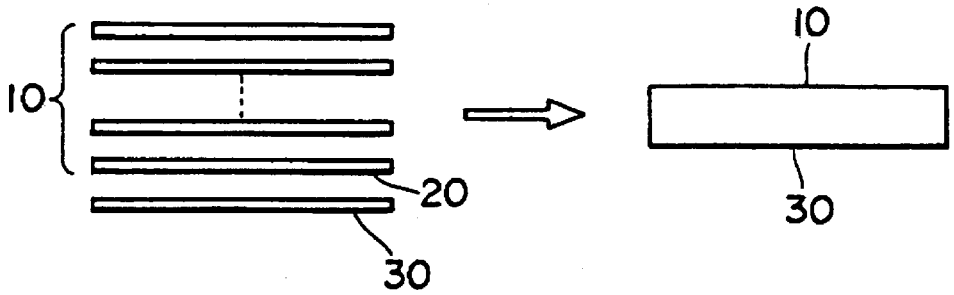
FIG. 11 is a diagram showing the configuration of a product before and after the step of laminating and pressing green sheets.

FIG. 11 shows different product configurations before and after the step of laminating and pressing green sheets which constitute dielectric sheets, for the purpose of manufacturing the aforesaid dielectric filter. First of all, formation of a green sheet is performed by a sheet forming machine which is not shown, and through-holes are formed in the green sheet by a punching machine. This process is performed on each green sheet which constitutes a laminated body. Then, as shown on the left side of an arrow in FIG. 11, a predetermined number of green sheets 10 are stacked each of which has a printed pattern corresponding to electrode portions and through-holes filled with a conductor. Then, a ceramics sheet 30, which has openings corresponding to the respective electrode portions of a filter which serve as circuit components, is stacked on the bottom of the stacked green sheets 10 which serves as a mounting face when the filter is provided as a finished product.

It is desirable that a sheet having good adhesion to a dielectric sheet be used as the ceramics sheet 30. For example, a ceramics sheet which contains a large amount of glass is suitable.

The stacked dielectric sheets on which the ceramics sheet 30 is stacked are fed to a hot press, and laminated and compressed as shown on the right side of the arrow in FIG. 11. The compressed product is cut into chips by a cutter. After external conductors are printed on the chips, the chips are burned in an electric furnace. After that, a finished product is obtained through evaluation and measurement.

Figure 12:
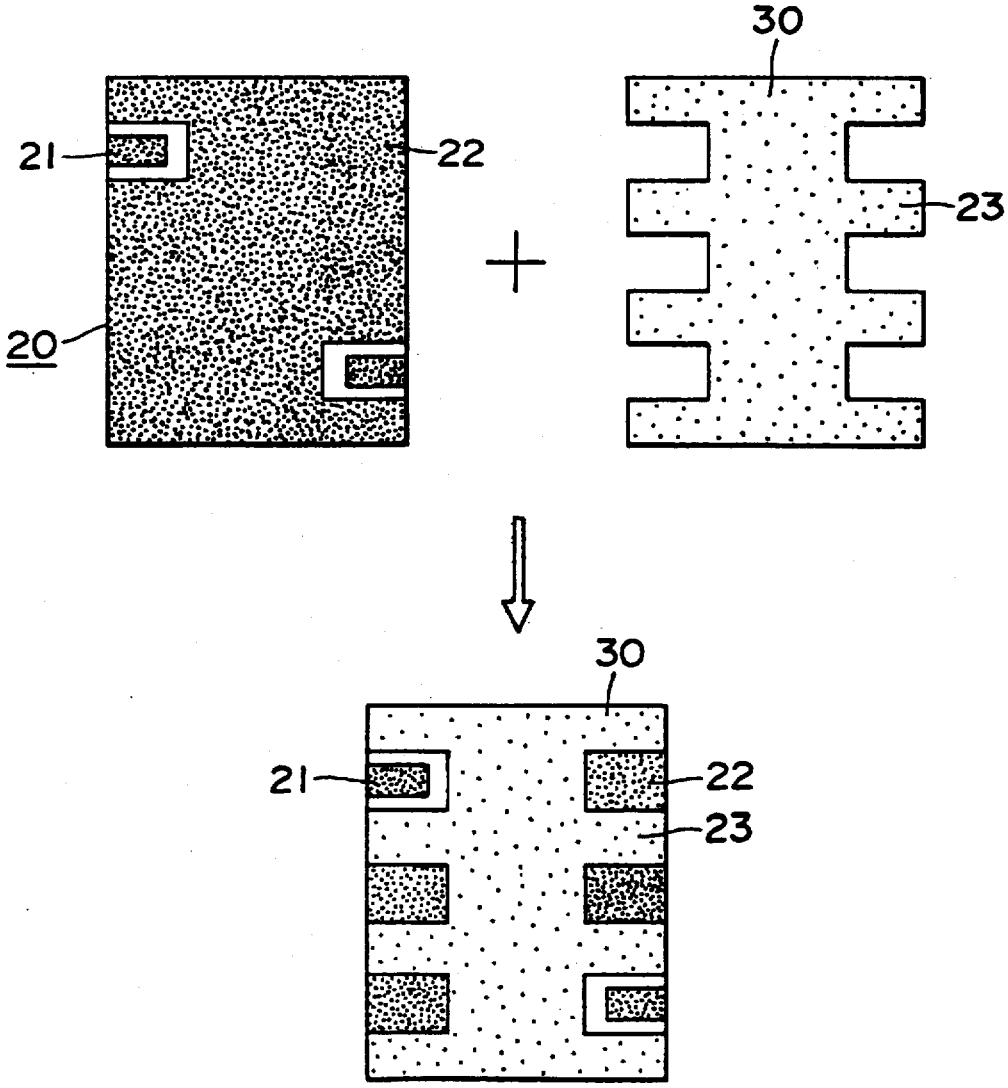
FIG. 12 is a diagram showing the step of providing a ceramics sheet on a mounting face of a filter.

FIG. 12 is a view of the step of forming a mounting face 20 of the filter, and shows the state of the bottom (the lower portion of FIG. 12) of a product obtained by stacking a solder mask (the right upper portion of FIG. 12) on the bottom (the left upper portion of FIG. 12) of the stacked dielectric sheets.

Specifically, electrodes 21 which constitute input/output terminals of the filter and electrodes 22 which constitute grounding terminals are formed on the mounting face 20 of the filter, that is, approximately four or six electrodes are provided at regular positions. These electrodes are connected to a pattern formed on the circuit board of a target device, for example, a telephone.

As shown in FIG. 12, two rectangular openings are formed on a diagonal line extending on the bottom of the filter. Each of the openings has a shape which surrounds the corresponding input/output terminals, in this case, a rectangular shape which matches the shape of the input/output terminal. In other words, each of the openings may be formed into various shapes, such as a semi-circular shape, which can allow solder to adhere to the terminal 21 or 22 and prevent solder from adhering to a conductor portion 28. The reason why the ceramics sheet 30 is employed is, therefore, to prevent unexpected electrical connection between the terminal electrodes 21 and the grounding electrodes 22 as a result of a positional deviation between the electrodes 21 or 22 and a pattern formed on the board of a circuit component which is to be mounted on the filter. More preferably, the ceramics sheet 30 may have good adhesion to not only the stacked dielectric sheets but also a circuit board on which the filter is to be mounted. The aforesaid ceramics sheet which contains glass is effective in that sense.

In addition, four grounding terminal electrodes are provided at regular positions in the portion of the mounting face of the filter which excludes the two rectangular openings. Thus, in the shown example, the two input/output terminals and the four grounding terminals, a total of six electrodes, are symmetrically disposed on the mounting face, i.e., the bottom of the filter.

Figure 13A:
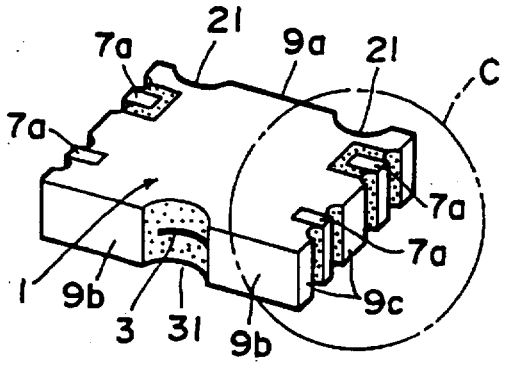
Figure 13C:
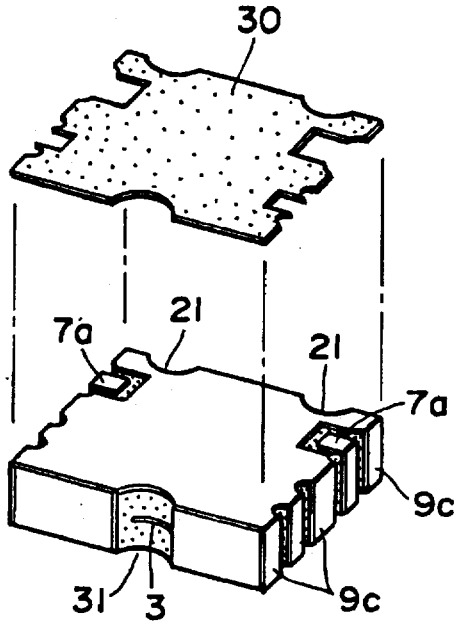
Figure 13B:
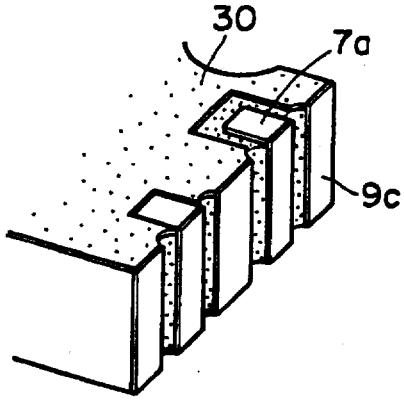
Figure 14:
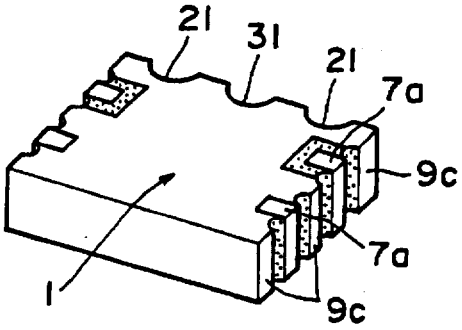
FIG. 14 is, similar to FIG. 13A, is a perspective view of a comb-line type filter, showing another embodiment of the present invention.

FIGS. 13A, 13B and 13C as well as FIG. 14 show a constitution in which the constitution shown in FIGS. 11 and 12 is applied to any of the embodiments shown in FIGS. 1 to 8. FIGS. 13A, 13B and 13C show an example in which the constitution shown in FIGS. 11 and 12 is adapted to an interdigital type of filter, whereas FIG. 14 shows an example in which the same constitution is adapted to a comb-line type of filter.

In the constitution shown in FIGS. 13A, 13B and 13C, the obverse grounding electrode 6 is formed substantially over the entire obverse face of the laminated board 1, and the obverse face of the laminated board 1, and the obverse input/output electrodes **7*a* are locally formed. Similarly, although not shown an reverse grounding electrode (denoted by reference numeral 5 in FIG. 3) is formed substantially over the entire reverse face of the laminated board 1, and reverse input/output electrodes (denoted by reference numeral 7*b* in FIG. 3**) are locally formed.

A plurality of strip-shaped resonance electrodes (only one resonance electrode 3 is shown) are formed in parallel on a predetermined one of the bonding faces of the plurality of dielectric sheets which constitute the laminated board 1. Each of the resonance electrodes extends the upper edge to the lower edges of the laminated board 1. The upper edge of the laminated board 1 is locally cut out to form the arc-shaped recesses 21 and 21 in which the upper ends of the corresponding resonance electrodes are respectively exposed. The upper edge grounding electrodes 9*a* are formed in the portion of the upper edge of the laminated board 1 that excludes the two recesses 21 and 21.

The resonance electrodes (denoted by reference numerals 2 and 4 in FIG. 3) which are formed in parallel on the opposite sides of the resonance electrode 3 reach the lower edge of the laminated board 1 and are connected to the lower edge grounding electrodes 9*b* at their respective ends. The other ends of these resonance electrodes are exposed in the respective electrodes 21 formed in the upper edge of the laminated board 1. Accordingly, by further cutting out the portions of the laminated board 1 that define the respective electrodes 21 it its possible to arbitrarily reduce that lengths of both resonance electrodes (2 and 4). Similarly, the resonance electrode 3 reaches the upper edge of the laminated board 1 and is connected to the middle one of the upper edge grounding electrodes 9*a* at its one end, while the other end of the resonance electrode 3 is exposed at the bottom of the recess 31 formed in the lower edge of the laminate board 1. Accordingly, by further cutting out the portion of the laminated board 1 that defines the recess 31, it is possible to arbitrarily reduce the length of the resonance electrode 3. In addition, since the open end of each of these resonance electrodes is positioned at the bottom of the corresponding recess which recedes from the external face of the laminated board 1, shielding characteristics are improved so that the influence of neighboring constituent components on the filter characteristics can be eliminated. Accordingly, it is possible to achieve effects and advantages similar to those of the above-described embodiments, and the portion of the mounting face in which no electrodes are formed does not need to be coated with a solder resists. Accordingly, unlike the prior art, it is not necessary to form a solder mask by coating the mounting face of a filter with the solder resist, whereby the entire manufacturing process can be made efficient and simple. In FIGS. 13B and 13C, reference numeral 30 denotes a dielectric sheet which is stacked on the conductor formed on the upper face of the filter.

FIG. 14 shows an example in which the constitution shown in FIGS. 11 and 12 is adapted to a comb-line type of filter. The constitution shown in FIG. 14 is similar to that shown in FIGS. 13A to 13C except that the open ends of the resonators (the two recesses 21 and the recess 31 interposed therebetween) are arrayed on the same side and that a grounding electrode is formed over the other side. Since the shown constitution can be readily understood by those skilled in the art, detailed description thereof is omitted herein.

What is claim is:

1. A method of producing a dielectric filter, wherein said dielectric filter comprises a laminated board having a plurality of dielectric sheets bonded together, a plurality of strip-shaped resonance electrodes formed in parallel on a predetermined bonding face of said dielectric sheets, input/output electrodes connected to said strip-shaped resonance electrodes and grounding electrodes formed on peripheral faces of said laminated board, said grounding electrodes and said resonance electrodes being separated from one another by recesses, said method comprising the steps of:

laminating said dielectric sheets to form parallel strip-shaped resonance electrode patterns and input/output electrode patterns of predetermined shapes on a surface of a predetermined one of said dielectric sheets by thermocompression;

forming through-holes by machining at positions where said dielectric sheets are cut for said resonance electrode patterns and forming said recesses and said laminated board by cutting said dielectric sheets at predetermined positions passing through said respective through-holes, and sintering said laminated board.

* * * * *